US009843131B2

(12) United States Patent
Kim et al.

(10) Patent No.: US 9,843,131 B2
(45) Date of Patent: Dec. 12, 2017

(54) CABLE CONNECTORS AND METHODS FOR THE ASSEMBLY THEREOF

(71) Applicant: Apple Inc., Cupertino, CA (US)

(72) Inventors: Min Chul Kim, San Jose, CA (US); Paul Z. Yuan, San Jose, CA (US); Xuan Liu, Champaign, IL (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/148,494

(22) Filed: May 6, 2016

(65) Prior Publication Data

US 2017/0054250 A1 Feb. 23, 2017

Related U.S. Application Data

(60) Provisional application No. 62/207,055, filed on Aug. 19, 2015.

(51) Int. Cl.

| | |
|---|---|
| ***H01R 4/50*** | (2006.01) |
| ***H01R 13/625*** | (2006.01) |
| ***H01R 4/02*** | (2006.01) |

(52) U.S. Cl.

CPC ..... *H01R 13/625* (2013.01); *H01R 4/023* (2013.01)

(58) Field of Classification Search

CPC ..... H01R 13/625
USPC ..... 439/339
See application file for complete search history.

(56) References Cited

U.S. PATENT DOCUMENTS

| | | | | |
|---|---|---|---|---|
| 6,364,681 | B1 * | 4/2002 | Watanabe | H01R 13/625 439/335 |
| 7,081,001 | B1 * | 7/2006 | Conroy | H01R 13/625 439/314 |
| 7,318,755 | B2 * | 1/2008 | Sauer | H01R 13/645 439/607.01 |
| 7,354,289 | B2 * | 4/2008 | Cannon | G01R 1/06788 439/314 |
| 7,507,125 | B2 * | 3/2009 | Okamura | H01R 13/506 439/680 |
| 7,824,204 | B2 * | 11/2010 | Fujiwara | H01R 13/5219 439/311 |
| 8,011,942 | B2 * | 9/2011 | Ohmori | H01R 13/6315 439/314 |
| 8,328,573 | B2 * | 12/2012 | Boucher | H01R 13/4532 439/137 |
| 8,708,731 | B2 * | 4/2014 | Chatelus | H01R 13/6271 439/350 |
| 9,325,113 | B2 * | 4/2016 | Pankau | H01R 13/6272 |

* cited by examiner

*Primary Examiner* — Tulsidas C Patel
*Assistant Examiner* — Peter G Leigh
(74) *Attorney, Agent, or Firm* — Van Court & Aldridge LLP

(57) ABSTRACT

A cable connector and methods for the assembly thereof are disclosed. The cable connector eliminates potential for short events during plug insertion, provides good contact resistance, and can support high speed data transactions. The cable connector further includes a rotating lock design that provides a secure connection.

19 Claims, 22 Drawing Sheets

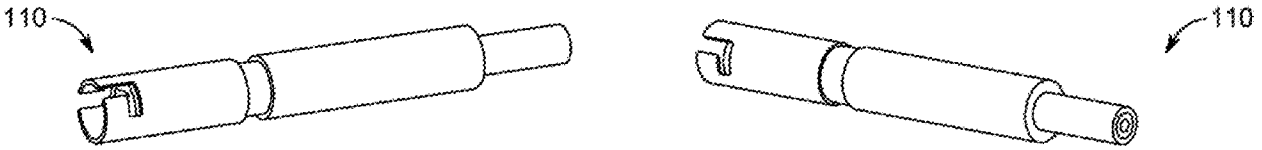
FIG. 3A
FIG. 3B
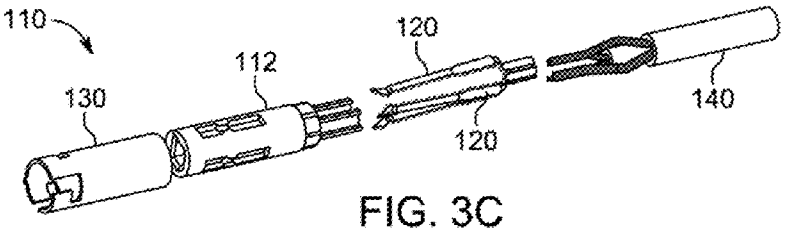
FIG. 3C
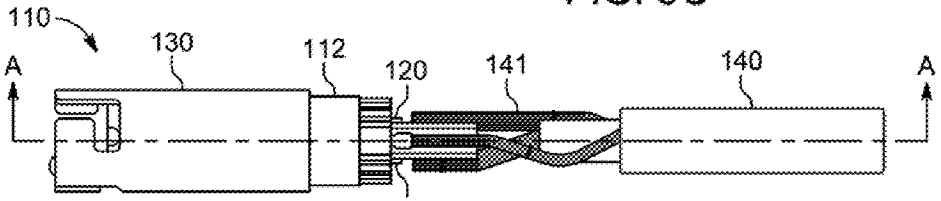
FIG. 3D
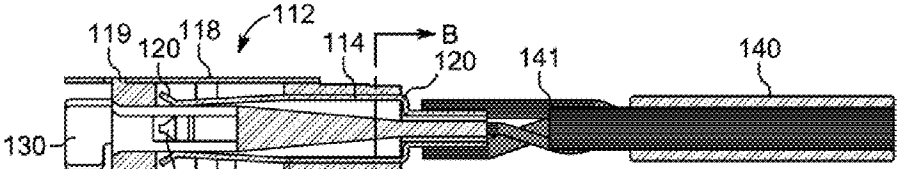
FIG. 3E
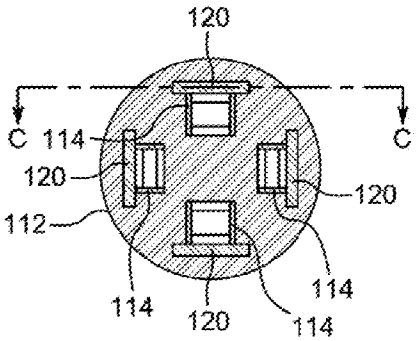
FIG. 3F

CABLE CONNECTORS AND METHODS FOR THE ASSEMBLY THEREOF

CROSS-REFERENCE TO A RELATED PATENT APPLICATION

This application claims the benefit of U.S. Provisional Patent Application No. 62/207,055, filed Aug. 19, 2015, the disclosure of which is incorporated by reference herein in its entirety.

TECHNICAL FIELD

This patent specification generally relates to electric cable connectors.

BACKGROUND

An electric cable may include one or more conductive lines or leads (e.g., wires) extending between a first connector assembly and a second connector assembly. Each connector assembly may be configured to electrically couple the conductive leads of the cable to a number of electrical contacts of the connector assembly. Conventional cable connectors have typically been made via standard inline audio jack. This type of connection has shortcomings such as, for example, as the plug is inserted into the jack, the front pin is the first pin that makes contact with the all the contacts, which can cause shorts. Special circuit protection may be needed to compensate for the short conditions.

SUMMARY

A cable connector and methods for the assembly thereof are disclosed. The cable connector eliminates potential for short events during plug insertion, provides good contact resistance, and can support high speed data transactions. The cable connector further includes a rotating lock design that provides a secure connection.

In one embodiment, a connector assembly is provided. The connector assembly can include a female sub-assembly having a circular cross-section and a male sub-assembly having a circular cross-section. The female sub-assembly can include a first core element having an opening for receiving a male sub-assembly, a first plurality of contacts disposed within the first core element, and a moveable locking member that at partially enshrouds the first core element and comprises a plurality of locking channels. The male sub-assembly can include a second core element having a interface portion constructed to be inserted into the opening, a second plurality of contacts disposed within the second core element, wherein the second plurality of contacts are coupled to the first plurality of contacts when the female sub-assembly and the male sub-assembly are connected together, and an overmold member that enshrouds a portion of the second core element, the overmold member comprising locking member protrusions that extend radially outward away from the second core element, wherein each locking member protrusion self-locks with a respective one of the locking channels when the moveable locking member is rotated from an unlocked position to a locked position.

In another embodiment, a female cable connector for use in being connected to a male cable connector is provided. The female cable connector can include a core element that includes a connector receiving region constructed to receive the male cable connector, a plurality of contact retaining regions positioned radially with respect to a center axis of the core element, and a plurality of contacts secured within respective ones of the contact retaining regions such that each contact includes an electrical coupling region that exists within the connector receiving region to make electrical contact with a contact contained in the male cable connector. The female cable connector includes a moveable locking member that at partially enshrouds the core element and comprises a plurality of locking channels to interlock with the male cable connector In yet another embodiment, a male cable connector for use in being connected to a female cable connector is provided. The male cable connector includes a core member comprising an insertion member constructed to fit into a receiving member of the female cable connector, a plurality of contact retaining regions positioned radially with respect to a center axis of the core element and that extend from the insertion member to a distal end of the core member, a cylindrical member that surrounds a portion of the insertion member and the plurality of contact retaining regions, and a plurality of contacts contained in respective ones of the contact retaining regions.

A method for assembling a cable connector is also provided. The method can include inserting a male connector into a female connector, wherein the male connector comprises an insertion member and a cylindrical member having a plurality of channel guiding members, and wherein the female connector comprises a receiving member that receives the insertion member, a plurality of retention members coupled to the receiving member, and a movable sleeve including a plurality of interlocking channels, wherein when the insertion member is inserted into the receiving member, the plurality of channel guiding members are aligned with respective ones of the plurality of retention members. The method can include sliding the moveable member in a linear direction along a central axis towards the male connector, wherein each of the interlocking channels slide past one of the aligned pairs of the retention member and channel guiding member, and rotating the moveable member around the central axis such that the interlocking channels travel in a direction orthogonal to the linear direction along the aligned pairs of the retention member and channel guiding member.

A further understanding of the nature and advantages of the embodiments discussed herein may be realized by reference to the remaining portions of the specification and the drawings.

BRIEF DESCRIPTION OF THE DRAWINGS

FIGS. 3A-3I show several different views of female connector according to various embodiments;

DETAILED DESCRIPTION OF THE INVENTION

Figure 1:
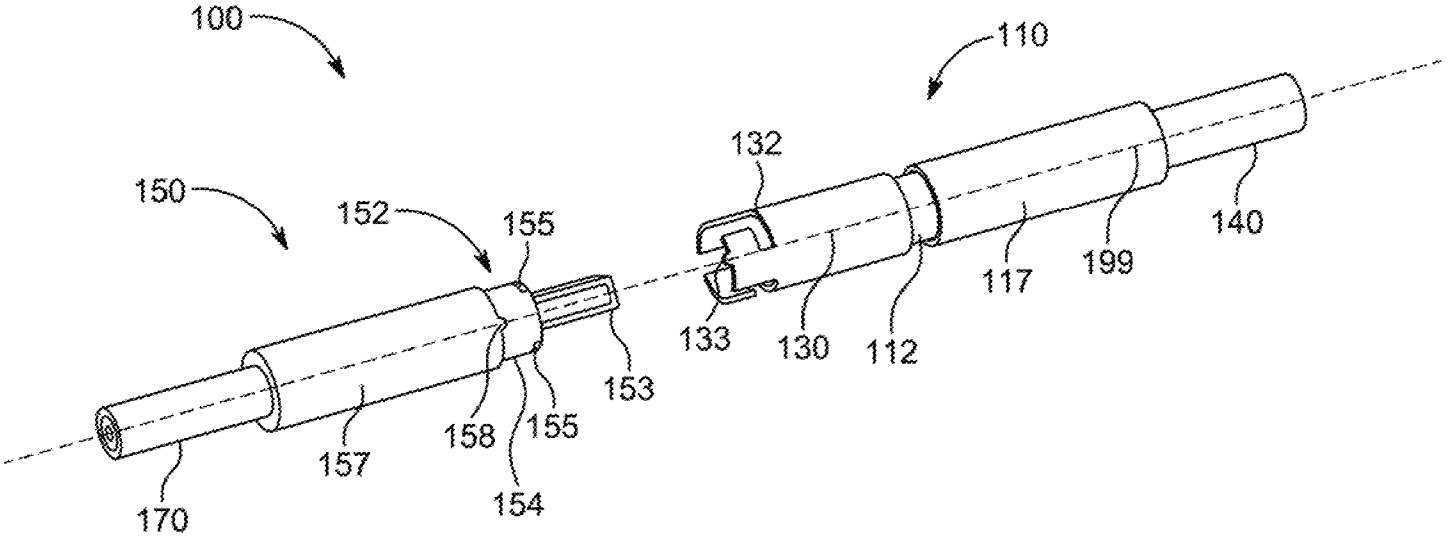
FIG. 1 shows illustrative cable connector in an uncoupled configuration, according to an embodiment.

In the following detailed description, for purposes of explanation, numerous specific details are set forth to provide a thorough understanding of the various embodiments of the present invention. Those of ordinary skill in the art will realize that these various embodiments of the present invention are illustrative only and are not intended to be limiting in any way. Other embodiments of the present invention will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

The cable connector according to embodiments discussed herein are designed to occupy the smallest possible size, yet still retain desired electrical and physical characteristics. The cable connector is cylindrical in shape and is intended to have an only slightly larger diameter than the cable to which it is attached. The cable connector can be designed to carry power and ground, or power, ground, and data. For example, in some embodiments, the impedance of the data contacts can be designed to accommodate relatively high speed data transfer such as USB 2.0.

The cable connector includes a female connector and a male connector where the male connector can be inserted and removed from the female connector. The contacts in both connectors may be arranged radially with respect to a central axis of both male and female connectors such that inadvertent short circuits among contacts are eliminated when both connectors are coupled together. The radial arrangement of the contacts refers to the different planar placement of the contacts around each connector. This planar arrangement can exist in both male and female connectors. That is a first contact may exist on a first plane, a second contact may exist on a second plane that is perpendicular to the first plane, a third contact may exist on a third plane that is a parallel to the first plane, but offset with respect to the first plane, and a fourth contact may be parallel to and offset with respect to the second plane. When the male and female connectors are mated together, the contacts in the male connectors are substantially co-planar with the respective contacts in the female connectors, thereby ensuring that only respective contacts make contact with each other.

The cable connector can also include an interlocking mechanism that prevents the male and female connector from disengaging. The female connector may include a moveable member that engages and locks to retention members of the male connector. That is, when the male connector is inserted into the female member, the moveable member can move linearly along the central axis in the direction towards the male connector. When the moveable member cannot move linearly any further, it can be rotated radially around the center axis to a locked position. The moveable member can any include at least one region that interfaces with at least one reciprocal region of the male connector to lock in place.

FIG. 1 shows illustrative cable connector 100 in an uncoupled configuration, according to an embodiment. Cable connector 100 can include female connector 110 and male connector 150. Female connector 110 shows core element 112, overmold 117, moveable member 130, and cable 140. Moveable member 130 can include interlocking channels 132 and interlocking friction members 133. Male connector 150 shows core element 152, overmold 157, and cable 170. Core element 152 can include insertion member 153 and cylindrical member 154, which can include channel guide locking members 155. Overmold 157 can include interlocking member 158. When connectors 110 and 150 are coupled together, insertion member 153 is inserted into a receiving member (not shown) of female member 110. Once inserted, moveable member 130 can slide axially along center axis 199 in the direction of male connector 150 such that an interlocking channel 132 slides around a respective one of the channel guide members 155. Moveable member 130 may stop sliding towards male member 150 when it abuts overmold 157, at which point it may be rotated around center axis 199 so that interlocking member 133 and 158 engage and lock moveable member 130 in place with respect to male member 150. The outer dimension of female connector 110 and male connector 150 may each be about 5 mm or less. Despite the relatively small outer dimension of connectors 110 and 150, cable connector 100 can carry up to 3 amps of current.

Figure 2A:
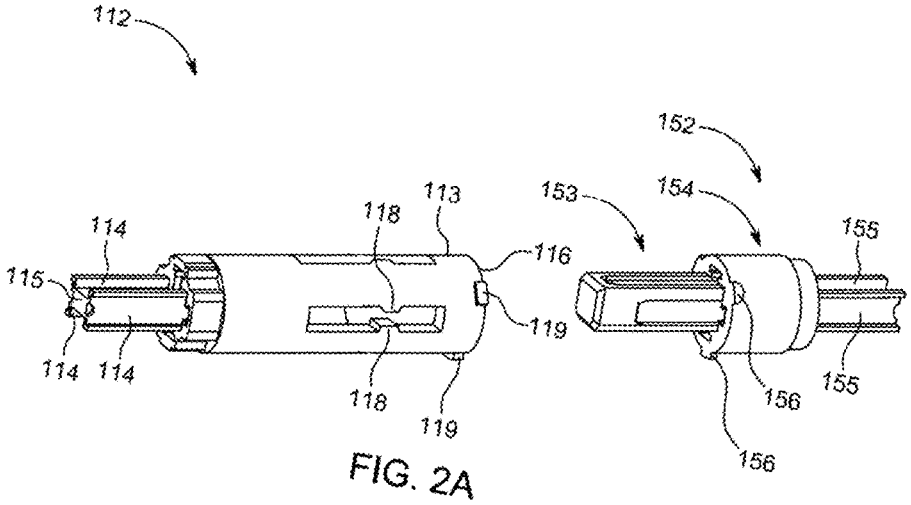
FIGS. 2A-2U show a series of assembly steps of various components in both female and male connectors according to various embodiments.
Figure 2B:
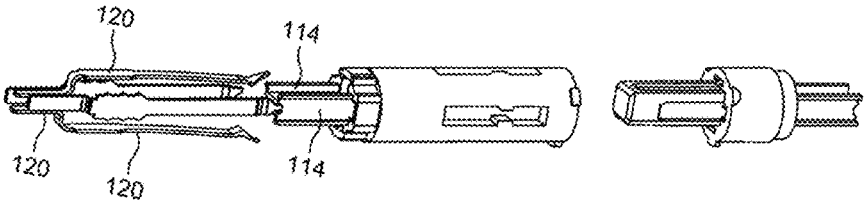
Figure 2C:
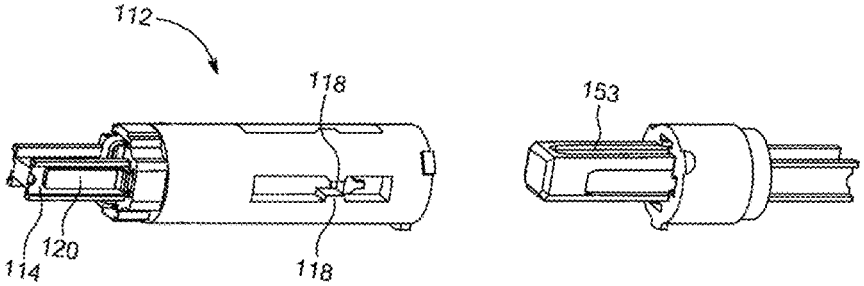
Figure 2D:
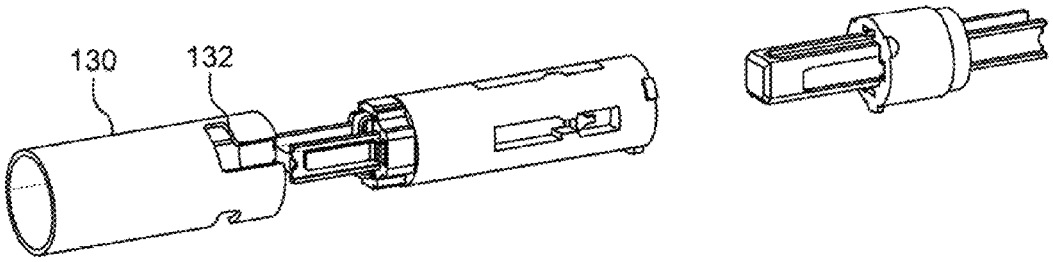
Figure 2E:
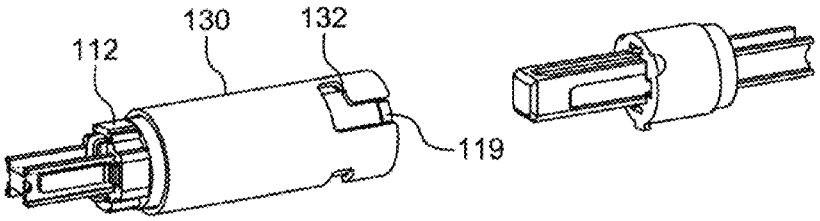
Figure 2F:
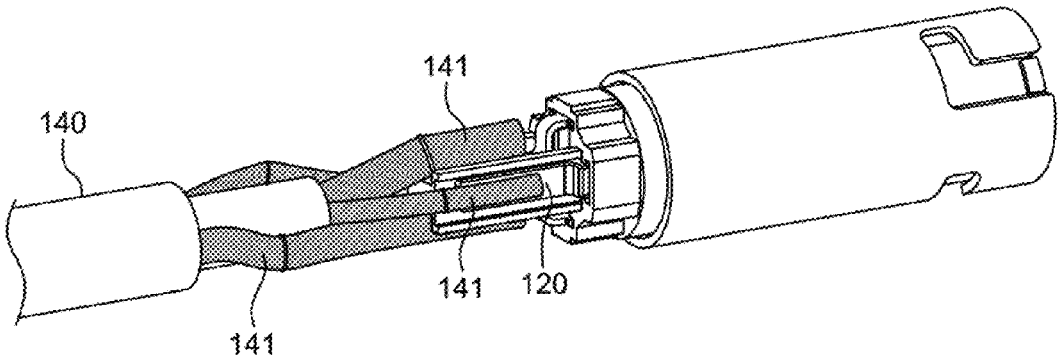
Figure 2G:
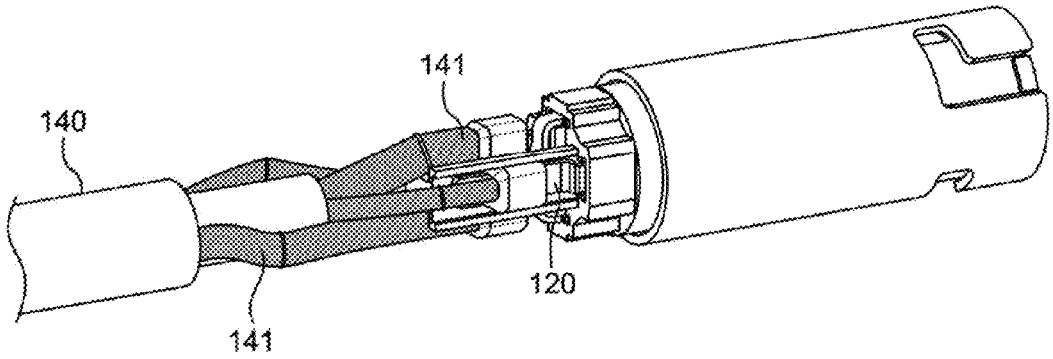
Figure 2H:
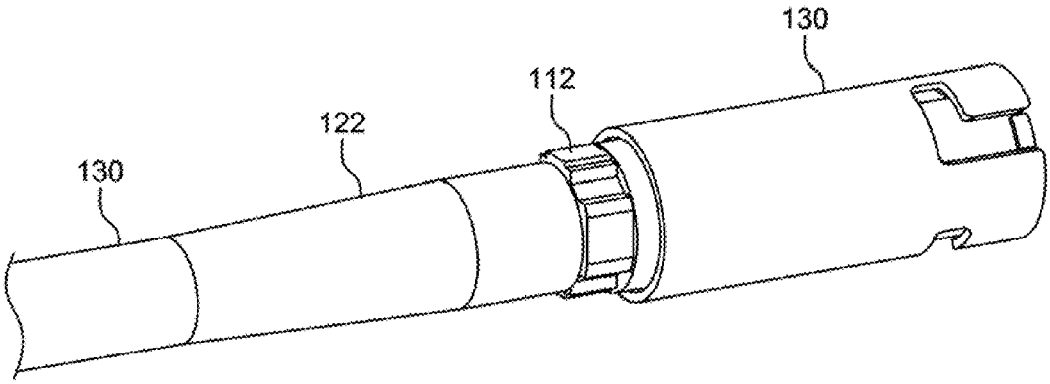
Figure 2I:
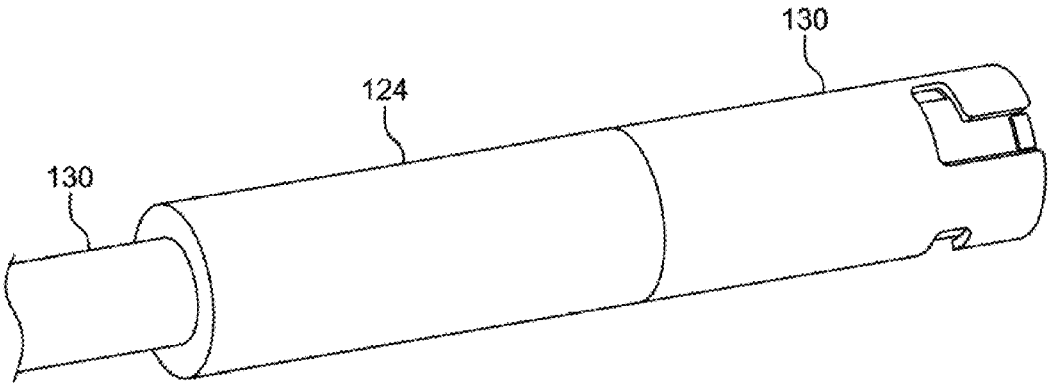
Figure 2J:
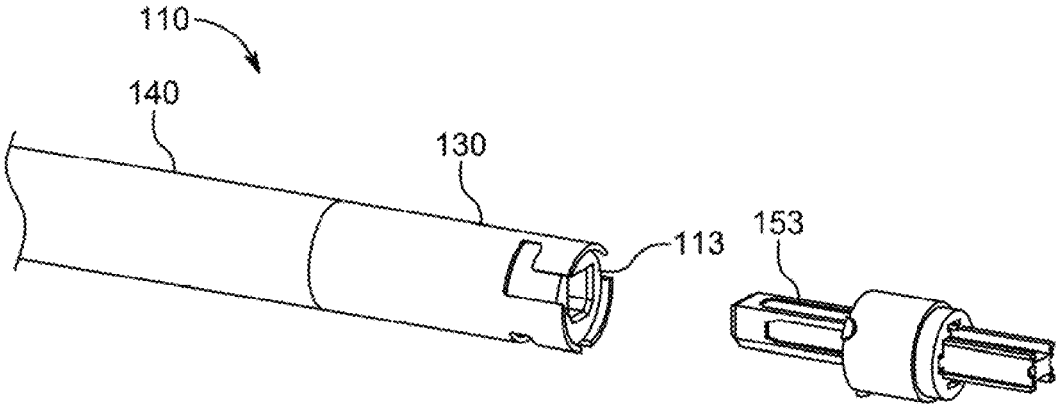
Figure 2K:
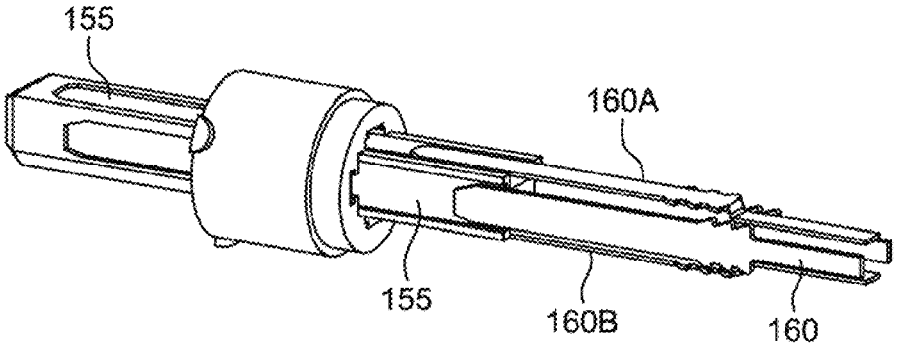
Figure 2L:
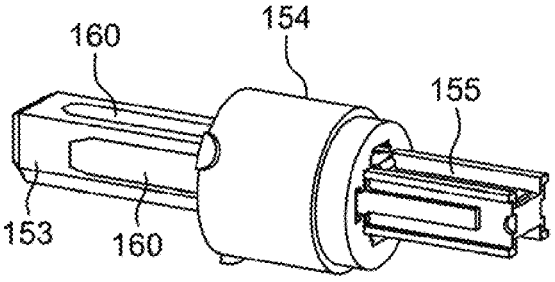
Figure 2M:
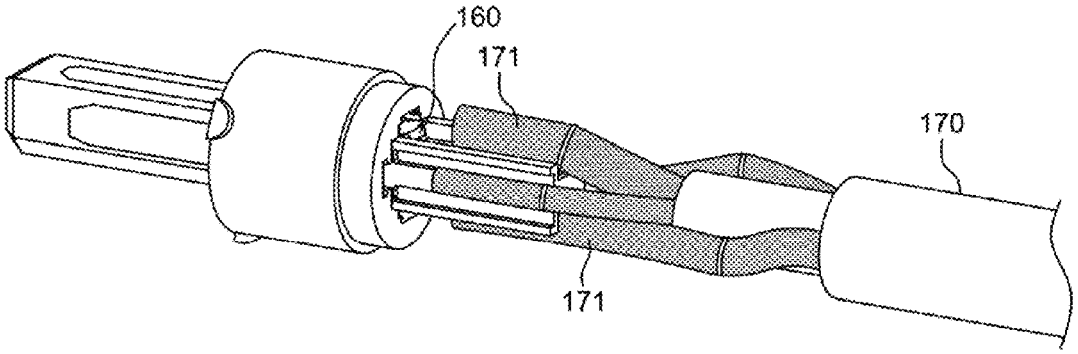
Figure 2N:
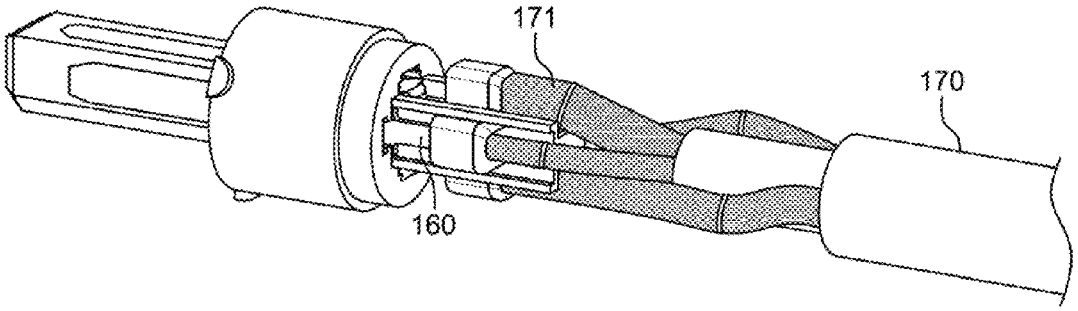
Figure 2O:
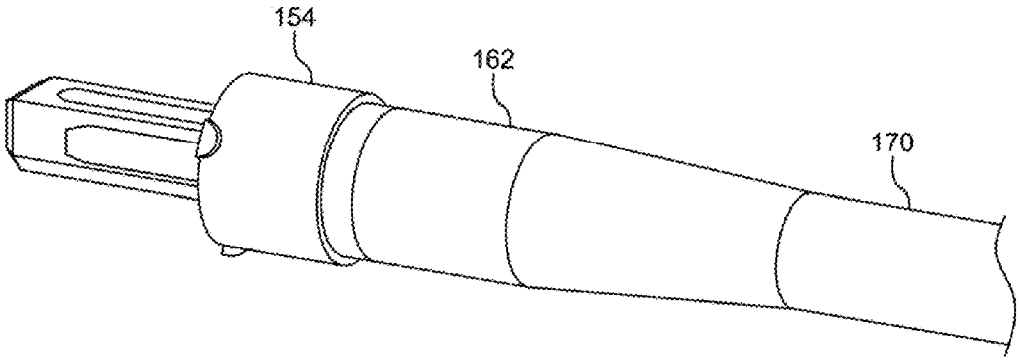
Figure 2P:
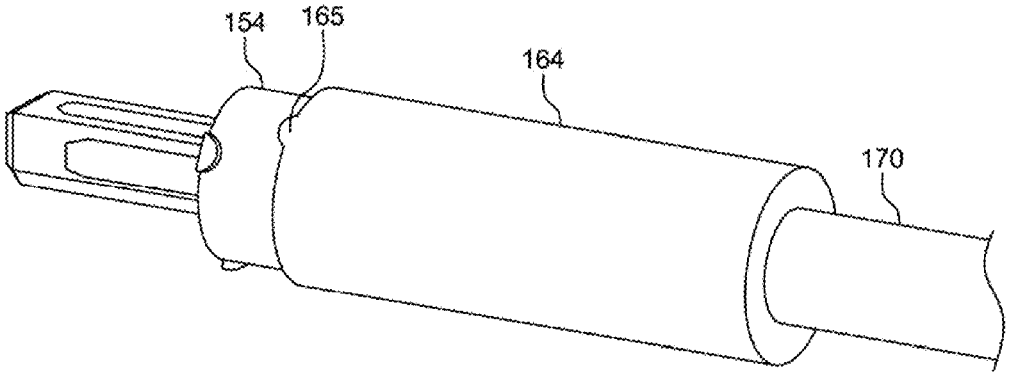
Figure 2Q:
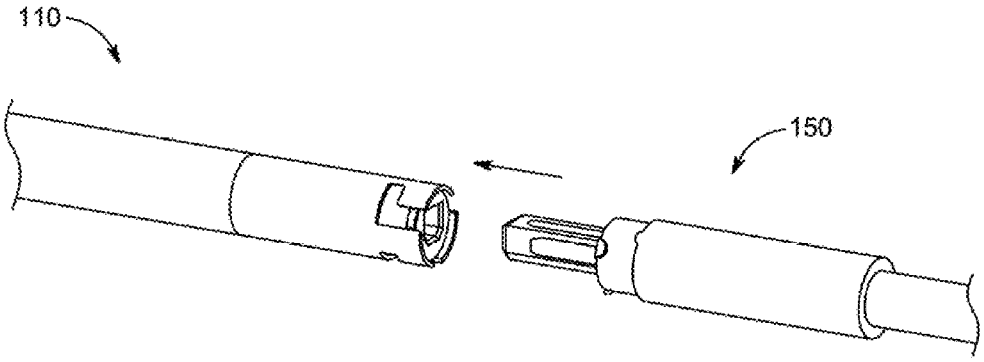
Figure 2R:
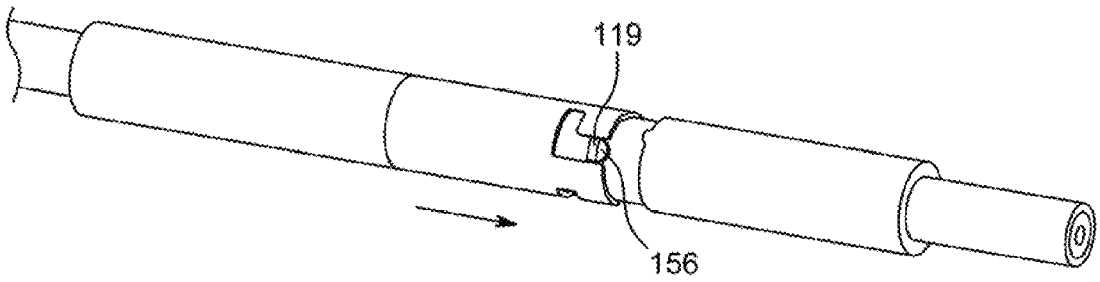
Figure 2S:
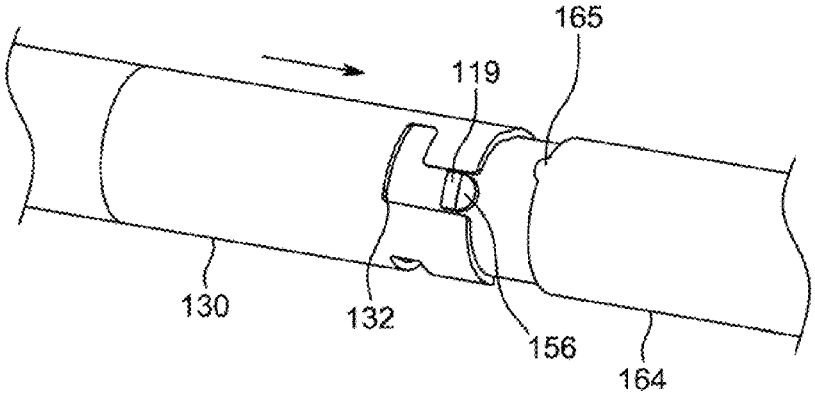
Figure 2T:
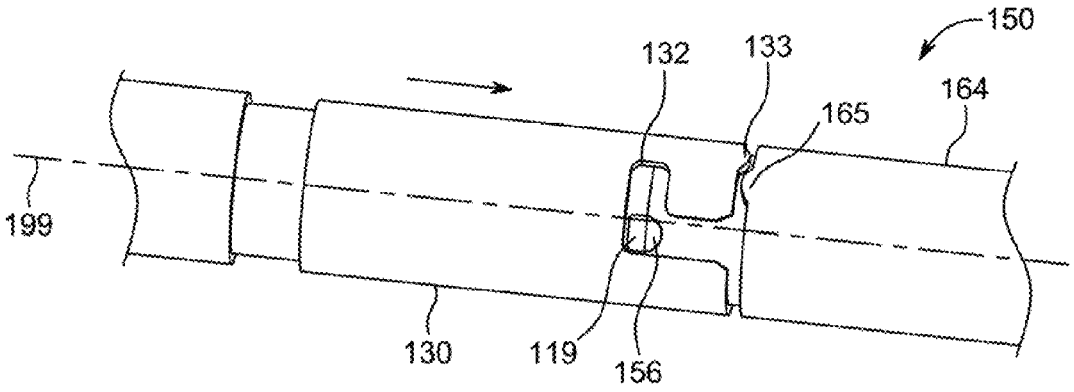
Figure 2U:
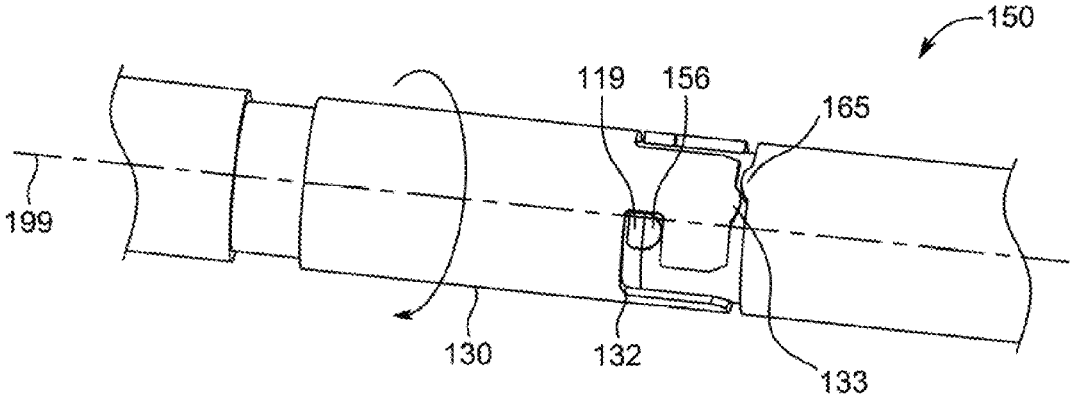

FIGS. 2A-2U show a series of assembly steps of various components in both female and male connectors according to various embodiments. The components of FIGS. 2A-2U are discussed in a more general fashion to facilitate a quick understanding of the connectors, but a more detailed explanation the components can be found elsewhere in this specification. Starting with FIG. 2A, core element 112 of female connector 110 is shown, and core element 152 of male connector 150 is shown. Core element 112 can include receiving member 113 that constructed to receive insertion member 153. Core element 112 can include contact retaining regions 114 (four of which exist in the FIG.) that span the length of core element 112 from end 115 to end 116 and are designed to hold contacts (not shown) in place within receiving member 113. Biasing members 118 may form part of receiving member 113 to prevent contacts (not shown) from extending out beyond a periphery of member 113. Retaining members 119 may extend radially away from member 113 and can serve as stops that prevent movable member 130 (not shown) from sliding off core element 112.

Core element 152 can include insertion member 153, cylindrical member 154, contact retaining regions 155 positioned radially with respect to a center axis of core element 152 and that extends from insertion member 153 to a distal end of core member 152. Four contact retaining regions may exist, but only two are shown in the FIG. Cylindrical member 154 can include at least one channel guiding member 156 that extends outward away from an outer surface of the cylindrical member. At least one channel guiding member is designed to interface with movable member 130 of the female cable connector.

FIG. 2B shows the addition of contacts 120 constructed to fit into and be retained by contact retaining regions 114, and FIG. 2C shows contacts 120 secured within contact retaining regions 114. Biasing members 118 prevent contacts 120 from protruding out of element 112 when insertion member 153 is inserted into element 112.

FIG. 2D shows addition of moveable member 130, which includes interlocking channels 132. In one embodiment interlocking channels may be "L" shaped. Moveable member 130 can be slid over core element 112, as shown in FIG. 2E. Retaining members 119 may prevent moveable member 130 from sliding off of core element 112.

FIG. 2F shows wires 141 within cable 140 being affixed to contacts 120 and FIG. 2G shows wires 141 soldered to contacts 120. In some embodiments, wires 141 can be 18 gauge wire. FIG. 2H shows first overmold 122 that surrounds wires 141 and the portion of contacts 120 where wires 141 are soldered thereto. First overmold 122 may have a taper that changes in diameter as it progresses from cable 140 to core element 112. FIG. 2I shows a second overmold 124 that surrounds first overmold 122 and a portion of core element 112. First overmold 122 may be less elastic than second overmold 124. Second overmold 124 may prevent moveable member 130 from sliding back down over core element 112 and cable 140. FIG. 2J shows another view of female connector 110 showing the opening of receiving member 113. As shown, receiving member 113 has a keying arrangement that ensures that insertion member 153 can be inserted in only one orientation.

FIG. 2K shows addition of contacts 160 being inserted into contact retaining regions 155. In particular, FIG. 2K shows contact 160A and contact 160B. Contact 160A may have a longer length than contact 160B. In this embodiment, since contact 160A is longer than contact 160B, it may be used as a ground pin to thereby establish a ground connection first before a power or data connection is established by contact 160B. FIG. 2L shows contacts 160 fully inserted in and retained in place within retaining regions 155. Note that the positioning of contacts 160 may differ depending on whether first mate, first break electrical connections are desired.

FIG. 2M shows wires 171 of cable 170 being connected to contacts 160, and FIG. 2N shows those wires being soldered onto contacts 160. In some embodiments, wires 171 can be 18 gauge wire. FIG. 2O shows first overmold 162 that surrounds wires 171 and is positioned between cylindrical member 154 and cable 170. First overmold 162 can have a taper, as shown. FIG. 2P shows second overmold 164 positioned over first movermold 162, a portion of cylindrical member 154 and a portion of cable 170. Second overmold 164 can include interlocking members 165 that are designed to interface with interlocking members 133. Second overmold 164 can be constructed from a material that is more elastic than first overmold 162.

FIG. 2Q shows male connector 150 being inserted into female connector 110 where insertion member 153 will be inserted in receiving member 113. FIGS. 2R and 2S show that when both connectors 110 and 150 are coupled together, respective retaining members 119 and channel guiding members 156 are aligned to provide guidance tracks for moveable member 130 to slide in a direction towards male member 150. FIG. 2T shows moveable member 130 has finished sliding towards male connector 150 as its interlocking channels 132 prevent further travel in the linear direction. Note that at this point, interlocking members 133 and 165 are in an unlocked position. In FIG. 2U, after moveable member 130 is rotated around a center axis, retaining members 119 and channel guiding members 156 further guide travel of moveable member 130. Note that at this point, interlocking members 133 and 165 are in a locked position, resulting in secured lock up the connector assembly. The connector assembly can remain locked until a user counter rotates movable member 130 to unhinge interlocking members 133 and 165 to enable male connector 150 to be removed from female connector 110. In one embodiment, channel guiding member 156 may be sized to be smaller than channel guiding member 119. This way, channel guiding member 156 is engineered to fail before channel guiding member 119.

Figure 3H:
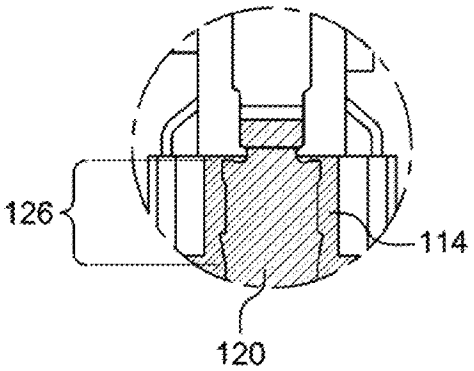

FIGS. 3A-3I show several different views of female connector 110 according to embodiments. FIGS. 3A and 3B show two different illustrative perspective views of female connector 110. FIG. 3C shows an illustrative exploded view of female connector 110, showing moveable member 130, core member 112, contacts 120, and cable 140. FIG. 3D shows an illustrative side view of female connector 110 without showing first or second overmolds 122 and 124. FIG. 3D shows moveable member 130, core member 112, contacts 120, cable 140, and wires 141.

FIG. 3E shows an illustrative cross-sectional view taken along line A-A of FIG. 3D. FIG. 3E shows with more particularity components contained within core element 112. That is, contacts 120 are shown be contained within contact retaining regions 114. Biasing members 118 show that contacts 120 are not permitted to deflect radially outward beyond biasing members 118. Retaining member 119 is shown to prevent moveable member 130 from sliding off core member 112. Wires 141 are shown coupled to contacts 120.

FIG. 3F shows an illustrative cross-sectional view taken along line B-B of FIG. 3E. FIG. 3F shows with more particularity, additional details on contact retaining regions 114 and contacts 120 as they relate to core member 112. FIG. 3G shows an illustrative cross-sectional view taken along line C-C of FIG. 3F. FIG. 3G shows another view of contact 120 being secured by contact retaining region 114, and in particular, shows retaining region 126 of contact 120 interfacing with retaining region 114. FIG. 3H shows a blown up view of section H of FIG. 3G that that shows this interface in more detail.

Figure 3I:
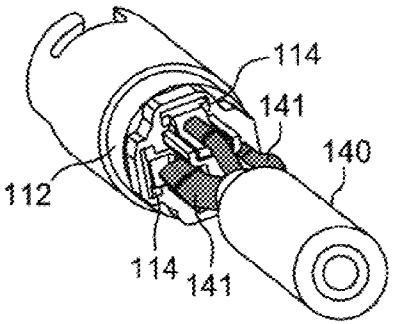
Figure 3G:
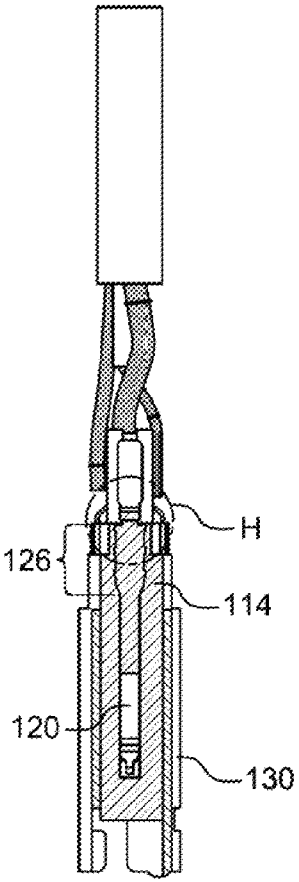

FIG. 3I shows an illustrative perspective view of female connector 110 that shows with emphasis wire connections to solder regions of contacts 120 and a distal end of core member 112. Wires 141 are shown to be soldered to different contacts 120, which are secured in place by retaining regions 114.

Figure 4D:
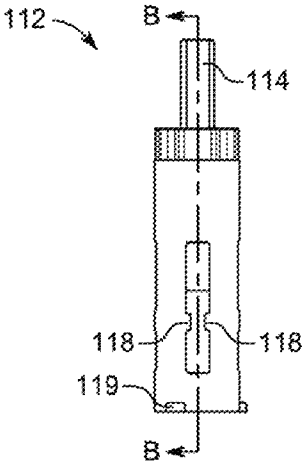
FIGS. 4A-4H show several different views of core member of the female member according to various embodiments.
Figure 4F:
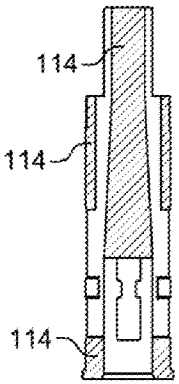
Figure 4C:
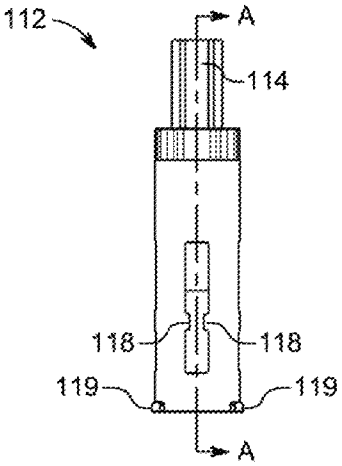
Figure 4E:
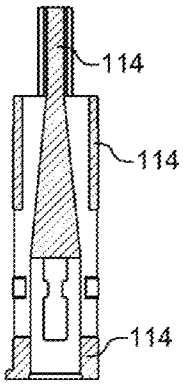
Figure 4A:
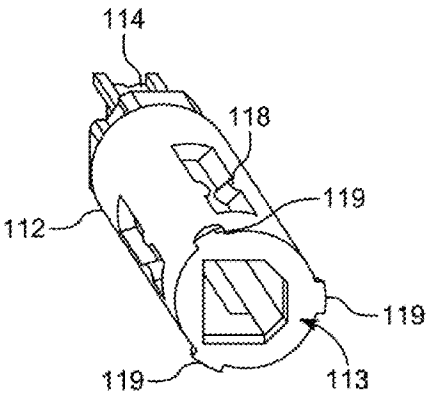
Figure 4B:
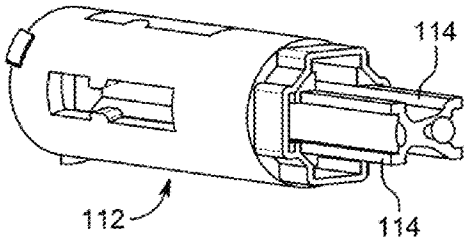

FIGS. 4A-4H show several different views of core member 112 of the female member according to embodiments. FIGS. 4A and 4B shows different illustrative perspective views of core member 112. FIG. 4A shows receiving region 113 of core member 112, along with biasing members 118, retaining members 119, and to a lesser extent, contact retaining regions 114. FIG. 4B shows distal end of core member 112 with emphasis on contact retaining regions 113. The distal end can represent where contacts (not shown) are inserted into retaining regions 114.

Figure 4H:
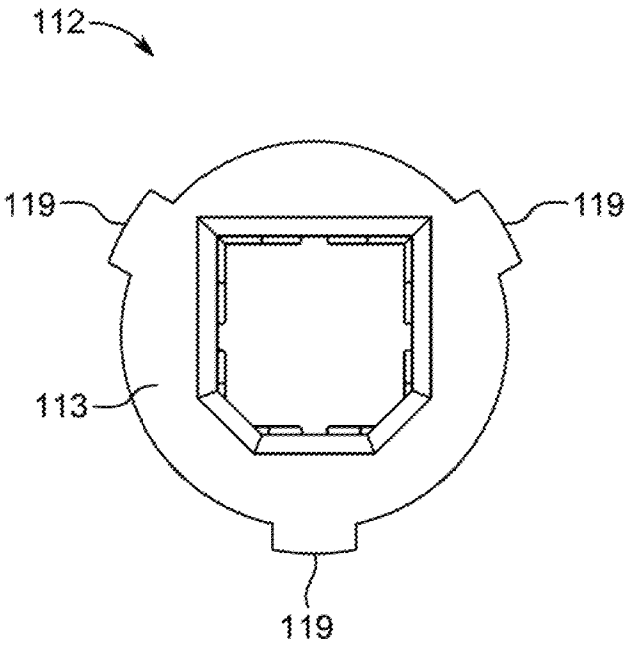
Figure 4G:
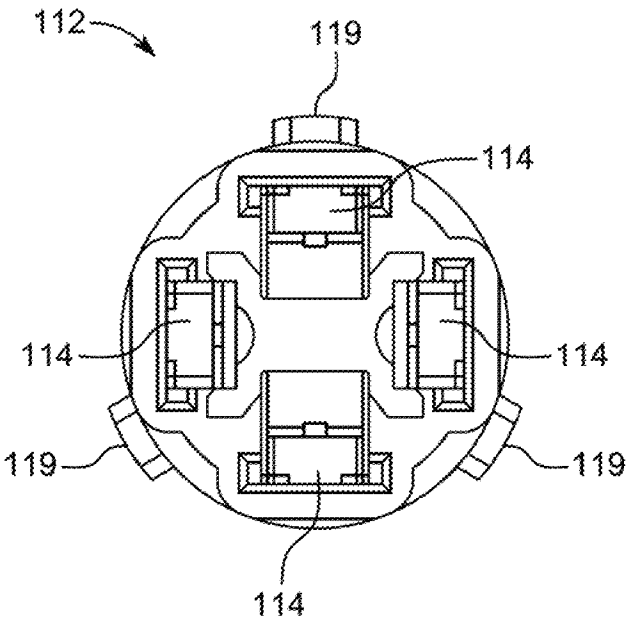

FIG. 4C shows an illustrative top view of core member 112 and FIG. 4D shows an illustrative side view of core member 112. Both FIGS. 4C and 4D show contact retaining regions 114, bias members 118, and retaining members 119. FIGS. 4E and 4F show illustrative cross-sectional views taken along lines A-A and B-B of FIGS. 4C and 4D, respectively. FIGS. 4E and 4F show additional details of contact retaining regions 114. FIG. 4G shows a back view of core member 112 and FIG. 4H shows a front view of core member 112, along with views of retaining regions 114, receiving member 113, and retaining members 119.

Figure 5:
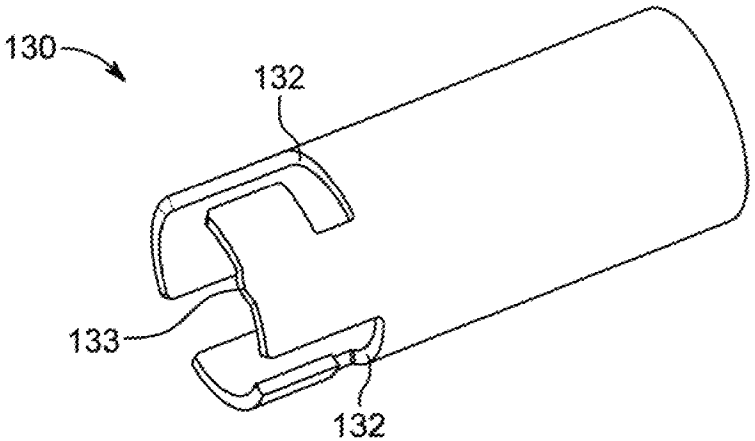
FIG. 5 shows an illustrative perspective view of moveable member according to an embodiment.

FIG. 5 shows an illustrative perspective view of moveable member 130 according to an embodiment Moveable member 130 can include interlocking channels 132 and interlocking members 133. In some embodiments, moveable member 130 can include only one interlocking member 133. Moveable member 130 may be constructed from a metal.

Figure 6A:
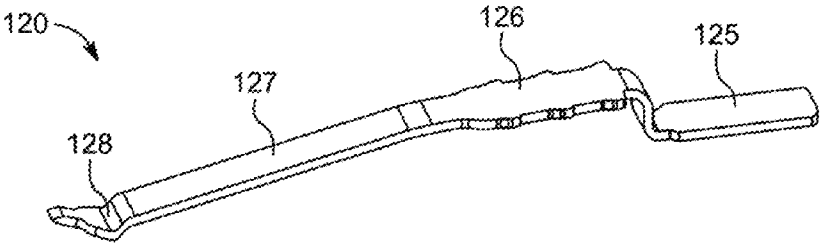
FIGS. 6A-6C show illustrative views of a contact according to various embodiments.
Figure 6B:
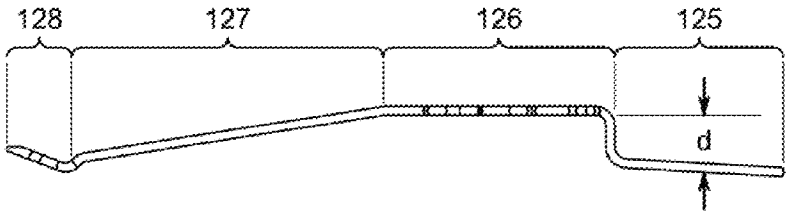
Figure 6C:
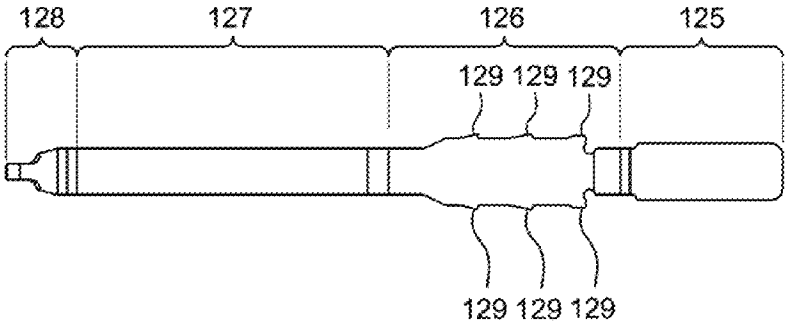

FIGS. 6A-6C show illustrative views of a contact according to various embodiments. FIG. 6A shows an illustrative perspective view, FIG. 6B shows a side view, and FIG. 6C shows a top view of contact 120. Contact 120 can include solder region 125, retention region 126, flex region 127, and electrical coupling region 128. Solder region 125 may be located where a wire is soldered to contact 120. Solder region 125 may be offset with respect to retention region 126 by distance, d, as shown. Retention region may include barbs 129 that secure contact 120 within contact retaining region 114 (not shown). Flex region 127 may represent a region that provides downward flex bias for electrical coupling region 128. This downward bias enables electrical coupling region 128 to extend into receiving member 113 (not shown) so that an electrical contact can be made with the male connector.

Figure 7B:
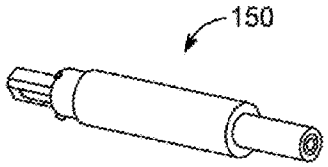
FIGS. 7A-7I show several different views of a male connector according to various embodiments.
Figure 7A:
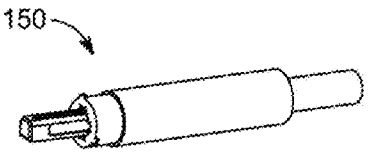
Figure 7C:
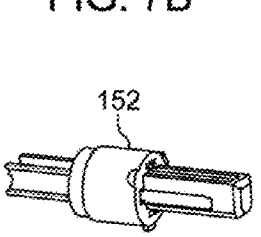
Figure 7C:
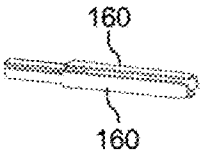
Figure 7D:
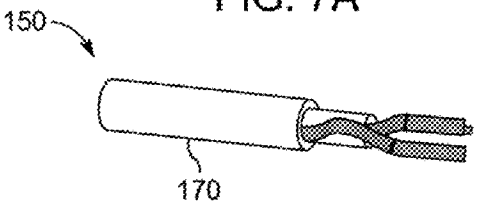
Figure 7D:
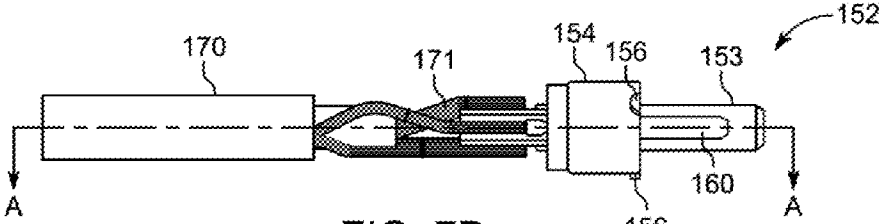

FIGS. 7A-7I show several different views of male connector 150 according to embodiments. FIGS. 7A and 7B show two different illustrative perspective views of male connector 150. FIG. 7C shows an illustrative exploded view of male connector 150, showing core member 152, contacts 160, and cable 170. FIG. 7D shows an illustrative side view of male connector 150 without showing first or second overmolds 162 and 164. FIG. 7D does show core member 152, insertion member 153, cylindrical member 154, channel guiding members 156, contacts 160, cable 170, and wires 171.

Figure 7F:
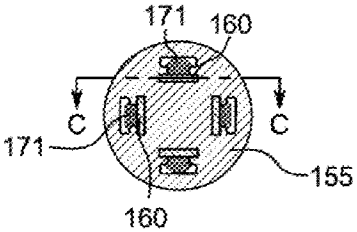
Figure 7E:
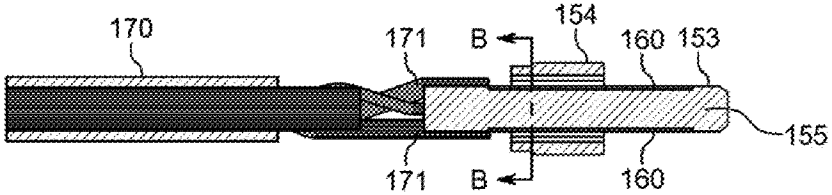

FIG. 7E shows an illustrative cross-sectional view taken along line A-A of FIG. 7D. FIG. 7E shows with more particularity components contained within core element 152. That is, contacts 160 are shown to be contained within contact retaining regions 155. Wires 171 are shown coupled to contacts 160.

Figure 7H:
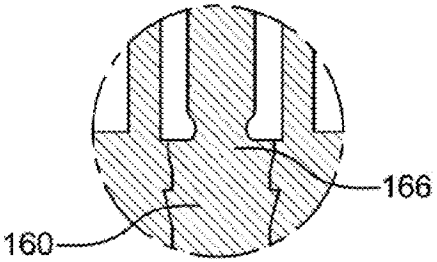

FIG. 7F shows an illustrative cross-sectional view taken along line B-B of FIG. 7E. FIG. 7F shows with more particularity, additional details on contact retaining regions 155, contacts 160, and wires 171 as they relate to core member 152. FIG. 7G shows an illustrative cross-sectional view taken along line C-C of FIG. 7F. FIG. 7G shows another view of contact 160 being secured by contact retaining region 155, and in particular, shows retaining region 166 of contact 160 interfacing with retaining region 155. FIG. 7H shows a blown up view of section H of FIG. 7G that that shows this interface in more detail.

Figure 7I:
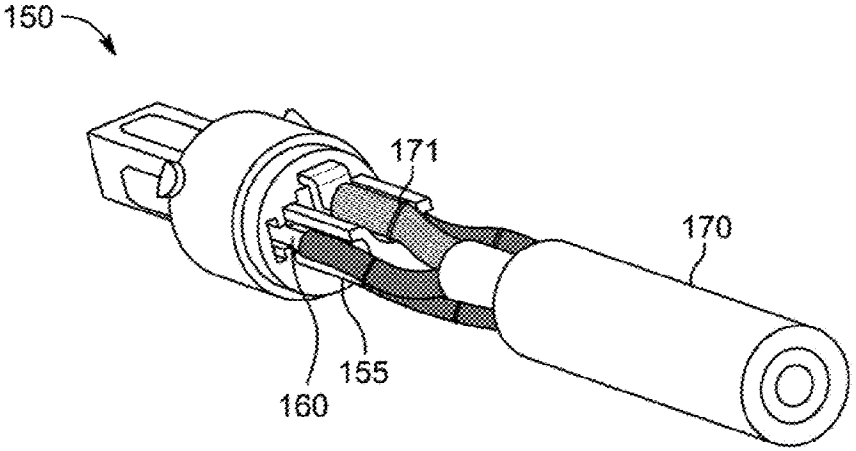
Figure 7G:
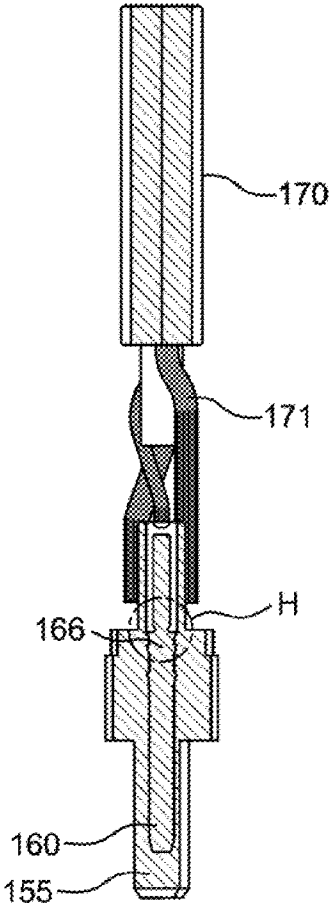

FIG. 7I shows an illustrative perspective view of male connector 150 that shows with emphasis wire connections to solder regions of contacts 160 and a distal end of core member 152. Wires 171 are shown to be soldered to different contacts 160, which are secured in place by retaining regions 155.

Figure 8:
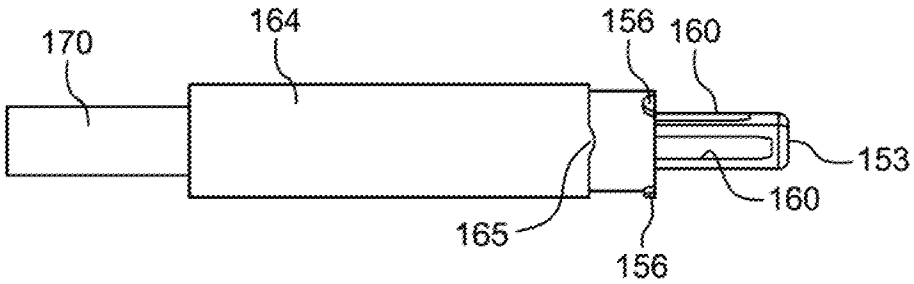
FIG. 8 shows an illustrative top view of the male connector with a second overmold according to an embodiment.

FIG. 8 shows an illustrative top view of male connector 150 with second overmold 164 according to an embodiment. In particular, FIG. 8 shows insertion member 153, channel guiding members 156, contacts 160, second overmold 164, interlocking member 165, and cable 170.

Figure 9A:
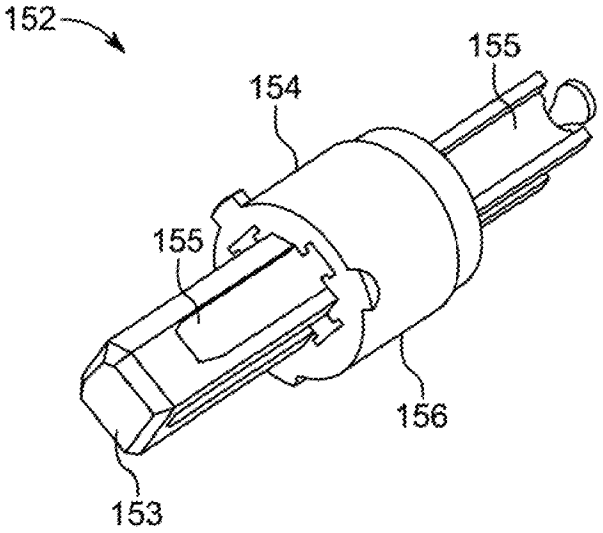
FIGS. 9A-9C show several different views of the male core member according to various embodiments.
Figure 9B:
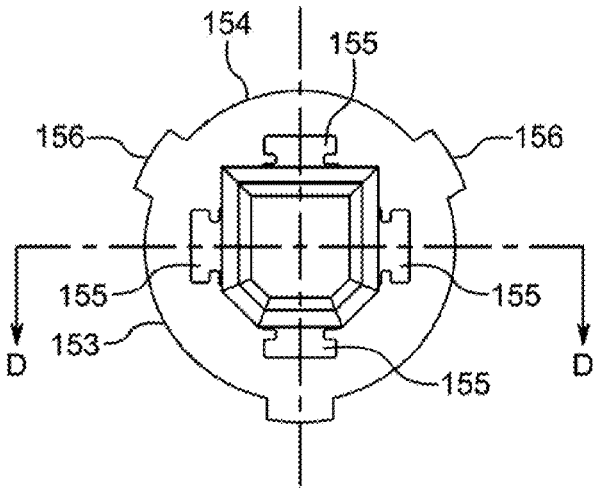
Figure 9C:
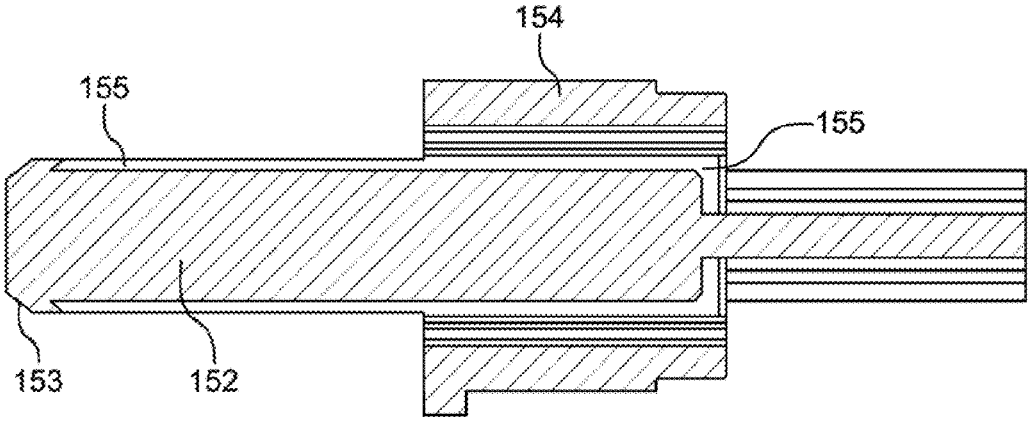

FIGS. 9A-9C show several different views of core member 152 according to various embodiments. FIG. 9A shows an illustrative perspective view of core member 152. FIG. 9A shows insertion member 153, cylindrical member 154, contact retaining region 155, and channel guiding member 156. FIG. 9B shows an illustrative side view of core member 152 showing insertion member 153, cylindrical member 154, contact retaining region 155, and channel guiding member 156. FIG. 9C shows an illustrative cross-sectional view taken along lines D-D of FIG. 9B. FIG. 9C shows that core member 152, contact retaining regions 155, and cylindrical member 154. Portions of retaining regions 155 located near insertion member 153 are tapered to thereby force contacts 160 (not shown) to nestle therein to promote male connector ingress into and egress from the female connector.

Figure 10A:
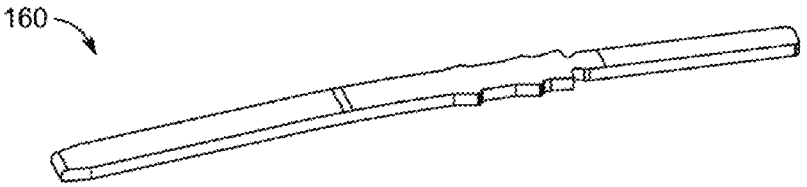
FIGS. 10A-10C show illustrative views of a contact for use in male connector 150 according to various embodiments.
Figure 10B:
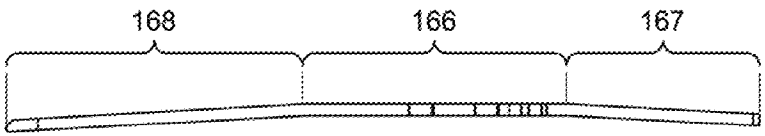
Figure 10C:
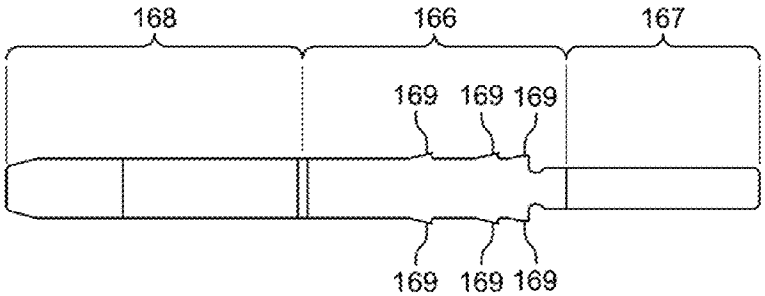

FIGS. 10A-10C show illustrative views of a contact for use in male connector 150 according to various embodiments. FIG. 10A shows an illustrative perspective view. FIG. 10B shows a side view, and FIG. 10C shows a top view of contact 160. Contact 160 can include solder region 167, retention region 166, and electrical coupling region 168. Solder region 167 may be location where a wire is soldered to contact 160. Retention region 166 may include barbs 169 that secure contact 160 within contact retaining region 155 (not shown). Retention region 166 may represent a baseline from which solder region 167 and electrical coupling region 168 are biased in a downward direction.

Figure 11:
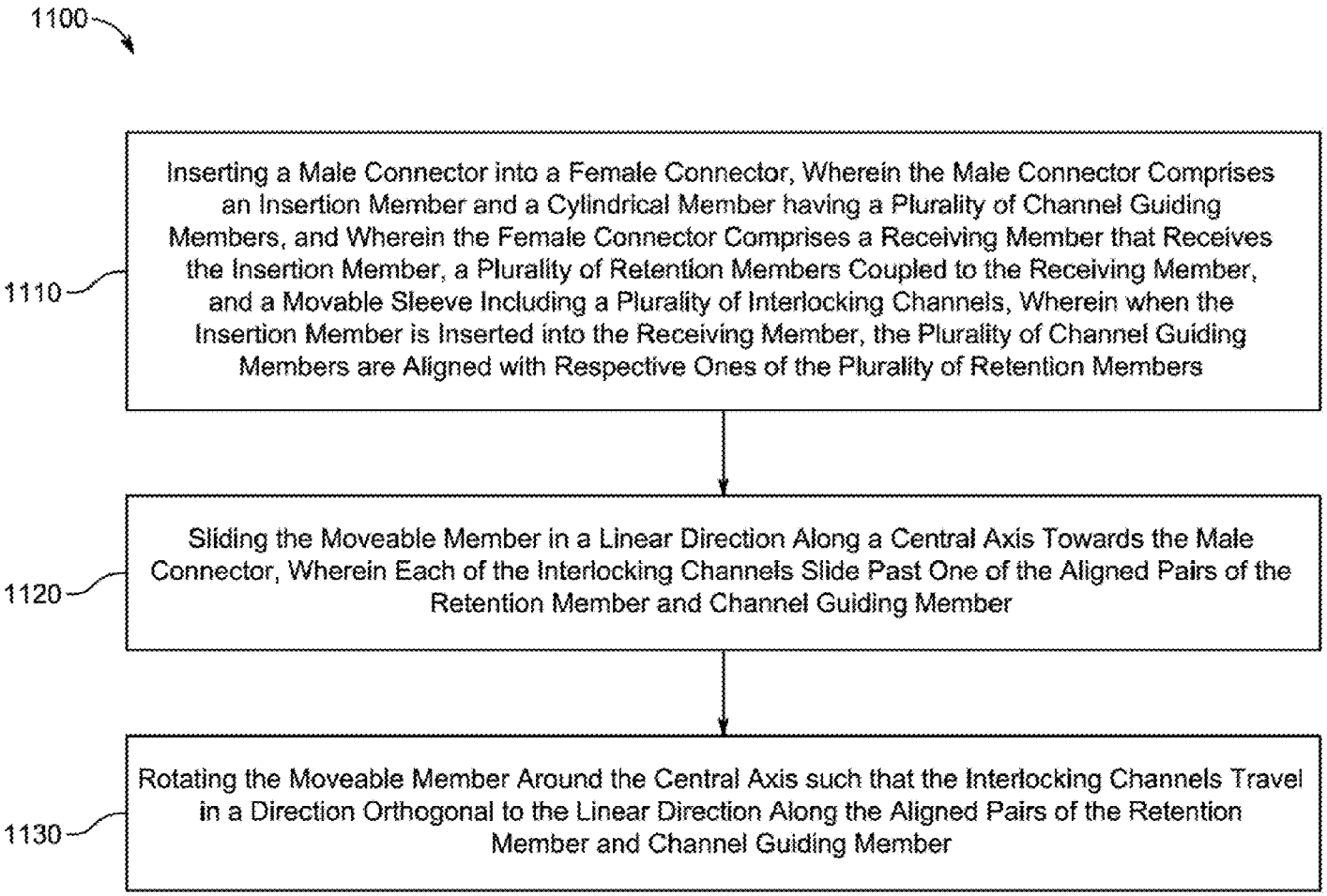
FIG. 11 shows an illustrative process 1100 for assembling a cable connector, according to an embodiment.

FIG. 11 shows an illustrative process 1100 for assembling a cable connector, according to an embodiment. Process 1100 can start at step 1110 by inserting a male connector into a female connector, wherein the male connector includes an insertion member and a cylindrical member having a plurality of channel guiding members, and wherein the female connector comprises a receiving member that receives the insertion member, a plurality of retention members coupled to the receiving member, and a movable sleeve including a plurality of interlocking channels, wherein when the insertion member is inserted into the receiving member, the plurality of channel guiding members are aligned with respective ones of the plurality of retention members. At step 1120, the moveable member can be slid in a linear direction along a central axis towards the male connector, wherein each of the interlocking channels slide past one of the aligned pairs of the retention member and channel guiding member. At step 1130, the moveable member can be rotated around the central axis such that the interlocking channels travel in a direction orthogonal to the linear direction along the aligned pairs of the retention member and channel guiding member.

Many alterations and modifications of the preferred embodiments will no doubt become apparent to a person of ordinary skill in the art after having read the foregoing description, it is to be understood that the particular embodiments shown and described by way of illustration are in no way intended to be considered limiting. Thus, references to the details of the described embodiments are not intended to limit their scope.

What is claimed is:

1. A connector assembly, comprising a female sub-assembly having a circular cross-section comprising:

a first core element having:

an opening for receiving a male sub-assembly;

a plurality of cutouts; and a plurality of protrusion members associated with each of the plurality of cutouts;

a first plurality of contacts secured to the first core element, wherein the protrusion members prevent the first plurality of contacts from extending beyond a periphery of the first core element via the cutouts when the male sub-assembly is inserted into the female sub-assembly; and a moveable locking member that partially enshrouds the first core element and comprises a plurality of locking channels; and the male sub-assembly having a circular cross-section comprising:

a second core element having an interface portion constructed to be inserted into the opening;

a second plurality of contacts secured to the second core element, wherein the second plurality of contacts each apply a force to the first plurality of contacts when the female sub-assembly and the male sub-assembly are connected together, wherein the force presses each of the first plurality of contacts against a respective one of the plurality of protrusion members; and an overmold member that enshrouds a portion of the second core element, the overmold member comprising locking member protrusions that extend radially outward away from the second core element, wherein each locking member protrusion self-locks with a respective one of the locking channels when the moveable locking member is rotated from an unlocked position to a locked position.

2. The connector assembly of claim 1, wherein the female sub-assembly comprises:

a plurality of conductors, each conductor coupled to a respective one of the first plurality of contacts.

3. The connector of assembly of claim 2, wherein the plurality of contacts are coupled to a device selected from the group consisting of a power adapter, a computer, and a mobile device.

4. The connector assembly of claim 1, wherein the male sub-assembly comprises:

a plurality of conductors, each conductor coupled to a respective one of the second plurality of contacts.

5. The connector assembly of claim 4, wherein the plurality of conductors are coupled to the connector.

6. The connector assembly of claim 1, wherein each one of plurality of locking channels comprises a L-shaped channel, wherein a first portion of the L-shaped channel permits movement along a linear axis, and wherein a second portion of the L-shaped channel permits movement along a rotational axis.

7. The connector assembly of claim 1, wherein the female sub-assembly comprises an outer diameter of 5 millimeters or less, and wherein the male sub-assembly comprises an outer diameter of 5 millimeters or less.

8. A female cable connector for use in being connected to a male cable connector, the female cable connector comprising:

a core element comprising:

a connector receiving region constructed to receive the male cable connector;

a plurality of contact retaining regions positioned radially with respect to a center axis of the core element; and a plurality of contacts secured within respective ones of the contact retaining regions such that each contact includes an electrical coupling region that exists within the connector receiving region to make electrical contact with a contact contained in the male cable connector; and a plurality of members that exist as part of a periphery of the core element and that prevent the plurality of contacts from extending beyond the periphery of the core element in a direction orthogonal to an insertion axis when the male cable connector is inserted into the female cable connector; and a moveable locking member that at partially enshrouds the core element and comprises a plurality of locking channels to interlock with the male cable connector.

9. The female cable connector of claim 8 further comprising a plurality of retaining members positioned at a distal end of the core element and operative to prevent the moveable locking member from sliding off of the core element.

10. The female cable connector of claim 8, wherein the male connector region comprises a keyed configuration that limits insertion of the male connector to only one orientation.

11. The female cable connector of claim 8, wherein each contact comprises:

a solder region;

a retention region coupled to the solder region;

a flex region coupled to the retention region; and wherein the electrical coupling region is coupled to the flex region.

12. The female cable connector of claim 11, wherein the retention region comprises a plurality of barbs that self-lock the contact into the contact retaining region.

13. The female cable connector of claim 8, wherein the moveable locking member comprises at least one dual axis channel that permits movement along a central axis and that permits movement radially with respect to the central axis.

14. A male cable connector for use in being connected to a female cable connector, the male cable connector comprising:

a core member comprising:

an insertion member constructed to fit into a receiving member of the female cable connector;

a plurality of contact retaining regions positioned radially with respect to a center axis of the core member and that extend from the insertion member to a distal end of the core member; and a cylindrical member that surrounds a portion of the insertion member and the plurality of contact retaining regions; and a plurality of contacts contained in respective ones of the contact retaining regions, wherein a portion of each of the plurality of contacts is exposed such that portion forms part of an outer surface of the core member.

15. The male cable connector of claim 14, wherein the contact retaining regions exist as channels within the insertion member and wherein the plurality of contacts are biased to bend in towards the channels.

16. The male cable connector of claim 14, wherein the plurality of contacts are arranged for first mate, first break electrical connections when coupled to the female cable connector.

17. The male cable connector of claim 14, wherein the cylindrical member comprises at least one channel guiding member that extends outward away from an outer surface of the cylindrical member, wherein the at least one channel guiding member is designed to interface with a movable member of the female cable connector.

18. The male cable connector of claim 17, further comprising an overmold positioned over a portion of the cylindrical member and over the plurality of contact regions extending from the cylindrical member towards the distal end, wherein the overmold comprises at least one protruding region designed to interface with the moveable member.

19. The male cable connector of claim 14, wherein each contact comprises:

a solder region;

a retention region coupled to the solder region; and a flexible contact region coupled to the retention region.

* * * * *